United States Patent [19]

Dubost et al.

[11] 4,015,265

[45] Mar. 29, 1977

[54] FOLDED DOUBLET ANTENNA

[75] Inventors: Gérard Dubost, Rennes; Henri Albert Paul Havot, Cesson-Sevigne, both of France

[73] Assignee: Etat Francais, France

[22] Filed: July 8, 1975

[21] Appl. No.: 593,957

[30] Foreign Application Priority Data

July 18, 1974 France ..... 74.24951

[52] U.S. Cl. ..... 343/747; 343/803; 343/807

[51] Int. Cl.[2] ..... H01Q 9/26

[58] Field of Search ..... 343/803, 804, 747, 807

[56] References Cited

UNITED STATES PATENTS

| | | | |
|---|---|---|---|
| 2,617,028 | 11/1952 | Stolk | 343/792 |
| 3,074,064 | 1/1963 | Pickles | 343/821 |

FOREIGN PATENTS OR APPLICATIONS

| | | | |
|---|---|---|---|
| 89,460 | 4/1956 | Norway | 343/803 |

*Primary Examiner*—Eli Lieberman

*Attorney, Agent, or Firm*—Stevens, Davis, Miller & Mosher

[57] ABSTRACT

A thick folded doublet antenna, the diameter of the current-receiving wire of which is on the order of ten times greater than that of the folded wire, the current-receiving wire comprising two half-wires of exterior symmetrical cylindrical form terminating at the center in two opposed frusto-conical portions, the small bases of which are close to each other, a coaxial conductor having an impedance of approximately 50 ohms extending axially through one of the half-wires, characterized in that the central conductor of the coaxial line is extended across the space between the bases of the frusto-conical portions and penetrates coaxially into a bore in the other half-wire, the central conductor being insulated from the other half-wire, the length of penetration of the central conductor being very short, and the coaxial line being supplied with signals at frequencies whose wavelengths are approximately six times the total height of said doublet antenna.

7 Claims, 4 Drawing Figures

FOLDED DOUBLET ANTENNA

The present invention relates to an antenna which is very short in relation to the wavelength, and more particularly, to an antenna of the thick folded doublet type operating at frequencies lower than the first resonant frequency.

Miniaturization of the dimensions of antennae is only of interest for frequencies of up to approximately several hundred MHz. Below 10 MHz, the electric field of atmospheric noise increases—at as little as 10 MHz, it is between 0.1 and 1 $\mu$V/m—and the signal/noise ratio no longer depends upon the entry stage of the receiver; a transistor can be fitted at the base of the antenna of reduced height to suit the radiation resistance, without appreciably altering the sensitivity of the reception system. Above 500 MHz, antennae are, of course, of reduced dimensions.

It is, however, well known that the reduction of the height of a conventional doublet antenna in relation to the wavelength is limited by the reduction of the radiation resistance and the reduction of the band pass. In fact, if the expressions $R + jX$ and Q are used respectively for designating the input impedance and the over-voltage coefficient of an antenna associated with matching circuits, then, according to R. W. King, "The Theory of Linear Antennas", Harvard University Press, Cambridge, Mass., 1956, the following relationships are obtained for a conventional symmetrical and cylindrical doublet antenna which has a height 2h and a diameter 2*a* and which is short in relation to the operating wavelength:

$$R = 20(\beta h)^2;\ X = \frac{-60(\Omega-3.4)}{\beta h};\ Q = \frac{3(\Omega-3.4)}{(\beta h)^3},$$

$$\text{wherein } \beta = \frac{2\pi}{\lambda} \text{ and } \Omega = 2\log_e \frac{2h}{a}.$$

wherein $\beta = 2\pi/\lambda$ and $\Omega = 2 \log_e 2h/a$. If, by way of example, a conventional doublet antenna wherein $h/\lambda = 0.085$ is considered—this corresponding to a one-third reduction in height in relation to the height of a half-wave doublet antenna wherein $h/\lambda = 0.02$ —the radiation resistance is approximately 6 ohms and does not vary appreciably as a function of the diameter of the doublet antenna, whereas the over-voltage coefficient is reduced from 330 to 70 when $\Omega$ varies from 20 to 7, but still remains large. Thus, with a conventional doublet antenna, the reduction in height, even though accompanied by thickening of the wire, results in an antenna having a very narrow band and low radiation impedance. The reactance X remains capacitive and must be balanced by a self-inductance. For a height-reduction ratio of 3, the reactance X that is to be balanced is on the order of several hundred ohms, and for a self-inductance of $0.04(\lambda)^{1.4}$ microhenry/meter having a frequency less than 100 MHz, this leads to envisaging a volume of 10 to 100 cm$^3$ with a quality coefficient of between 75 and 200. Since the dimensions of the self-inductance arranged in series at the base of the miniaturized antenna should be small in view of the height of the latter, its loss-resistance will thus be on the order of several ohms, that is to say, on the same order of magnitude as the radiation resistance of the shortened doublet antenna. Furthermore, the input resistance amounting to several ohms has to be matched to the nominal resistance of the supply source, for example, 50 ohms, by means of an impedance transformer which results in additional losses. Finally, the energy yield is mediocre. Thus, a conventional short doublet antenna permits operation only over a very narrow band with low yield.

An object of the present invention is to provide, for the purpose of avoiding the above-mentioned disadvantages, a thick folded doublet antenna operating at frequencies lower than the first resonant frequency.

French Patent filed on May 21, 1973 under the number, 73 19255, and entitled "Folded Doublet Antenna System", discloses an arrangement of thick folded doublet antennae in which each thick folded doublet antenna has broad band pass properties for frequencies distinctly higher than the first resonant frequency, the diameter of the current-receiving wire of the doublet antenna being on the order of ten times greater than that of the folded wire and on the order of one-tenth of the free space wavelength corresponding to the upper banndpass frequency.

Another object of the present invention is to provide such a thick folded doublet antenna associated with a compensation circuit to enable it to operate at frequencies lower than the first resonant frequency in a relatively broad frequency band with very good energy yield.

According to one feature of the invention, a thick folded doublet antenna has a current receiving wire with a diameter on the order of ten times greater than that of the folded wire; the current-receiving wire comprises two half-wires of exterior symmetrical cylindrical form, terminating at the center in two opposed frusto-conical portions, the small bases of which are closely spaced apart from each other. A coaxial line, which preferably has a nominal impedance of approximately 50 ohms, extends transversely through one of the half-wires. The central conductor of the coaxial line extends toward the other half-wire and passes through the space between the small bases of the frusto-conical portions, penetrating coaxially into the other half-wire from which it is insulated. The length of penetration of the central conductor into the other half-wire is very short.

In accordance with another feature, the second half-wire has a coaxial bore of relatively small diameter. A cylinder of insulating material is mounted in this bore surrounding and extending slightly beyond the length of penetration of the central conductor. The position of the insulating cylinder is preferably adjustable by a sliding action of the cylinder in the bore.

In accordance with a further feature, the coaxial line extending axially through one of the half-wires is interrupted within that half-wire, and a printed circuit is interposed in series between the two interrupted parts of the coaxial line. The printed circuit comprises: an impedance band line characteristic of 50 ohms, the narrow conductor of which connects the central conductors of the interrupted coaxial line, and the wide conductor of which is connected to the electrically conducting grounded outer conductor of the coaxial line; a capacitor is connected between the narrow conductor and the ground conductor; and a self-inductance constituted by a conducting wire is connected between the narrow conductor and the ground to form an antiresonant electric circuit. The printed circuit is housed within the half-wire.

Other features of the present invention will be seen more clearly from the following description of an embodiment, described below with reference to the annexed drawings, in which.

Figure 3:
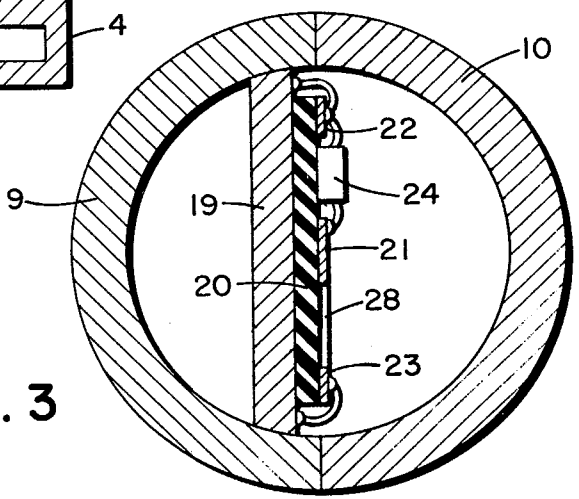
Figure 2:
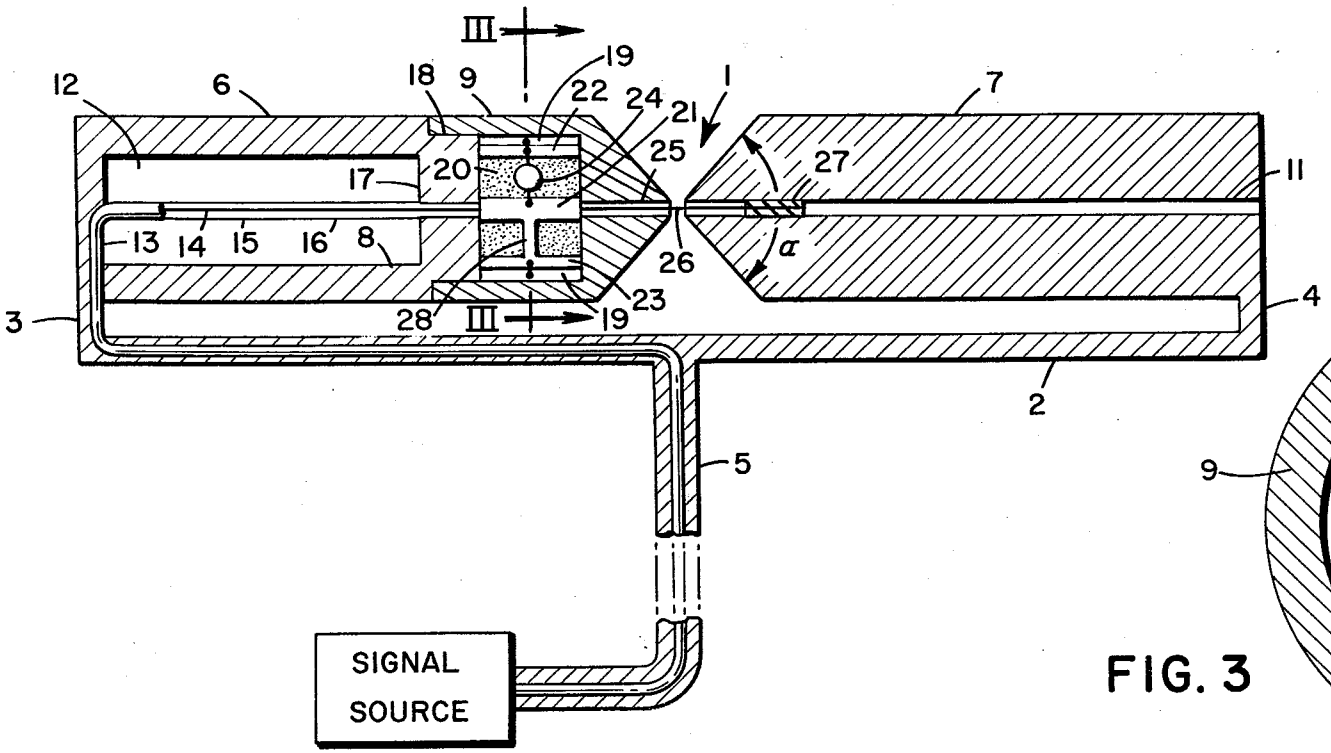
FIG. 2 is an axial section through a folded doublet antenna comprising the associated means of the invention.
Figure 4:
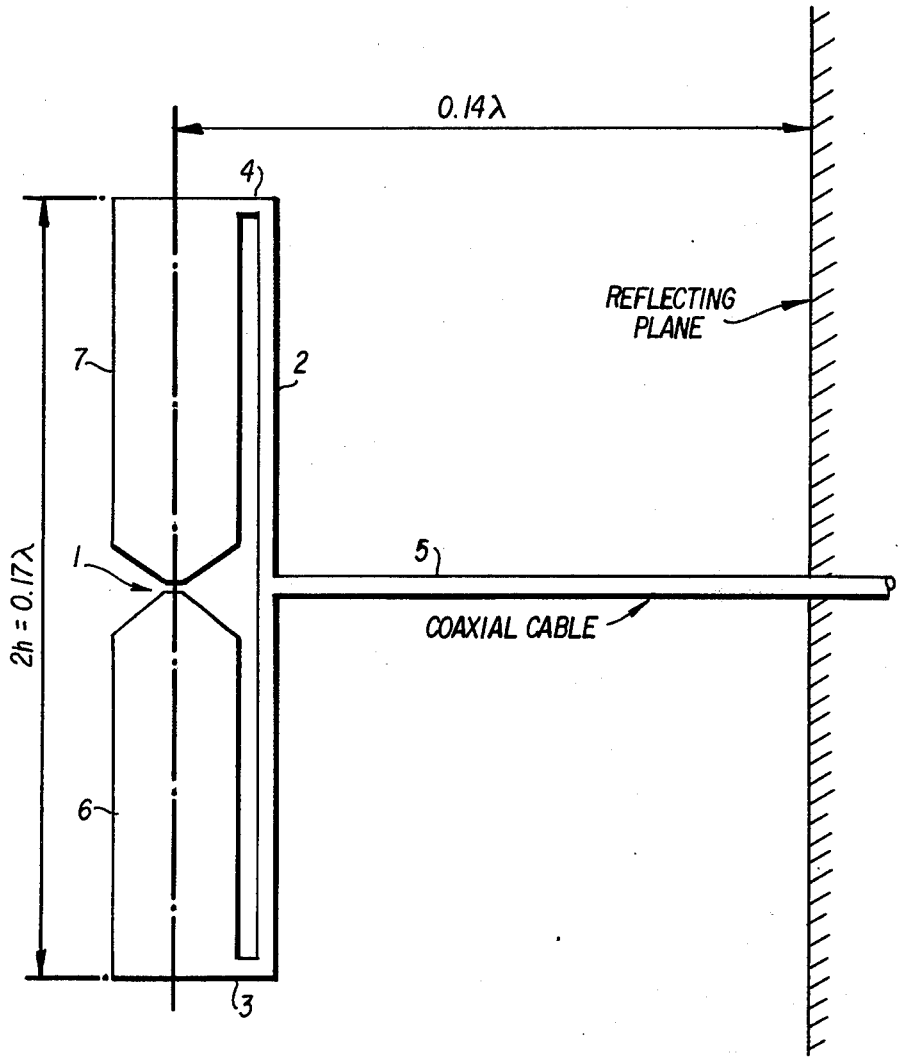

FIG. 3 is a cross-section through the doublet antenna of FIG. 2, on the line III—III, and FIG. 4 shows the doublet antenna spaced from a reflecting plane As in the above-mentioned French Patent Application, the folded doublet antenna shown in FIG. 2 comprises a current-receiving or energized wire 1 and a folded wire 2. The two wires 1 and 2 are rigidly held together by cheeks 3 and 4 made, like the wires, of an electrically conducting material. The wire 2 is a cylinder welded at its middle to a rigid cylindrical support 5 which is perpendicular to the wire 2.

As already stated, the wire 1 is the energized wire and therefore comprises two separate parts—a left-hand part 6 and a right-hand part 7. These two parts terminate at the center in symmetrical opposed frusto-conical portions, the small bases of which are close to each other; the rest of the parts 6 and 7 are cylindrical and of the same diameter as the large bases of the frusto-conical portions. In practice the part 6 is made up of three elements: a hollow cylinder 8 and two shell-halves 9 and 10 which, when fitted together by suitable means, not illustrated, form the frusto-conical portion 6. The part 7 is preferably a single element having an axial bore 11. The cylinder 8 contains a chamber 12 through which passes a coaxial feed cable 13 comprising a central conductor 14, an insulating part 15 and an outer cylindrical conductor 16. The chamber 12 is bounded at the left by the cheek 3 which may be removable, and at the right by a solid cylindrical part 17 having a bore through which extends the insulating member 15 and the central conductor 14 of the coaxial feed cable 13, the diameter of the bore being equal to that of the outer cylindrical conductor 16, the end of which is butt-welded to the part 17. The part 17 has an exterior cylindrical shoulder 18 on which is fitted the shell-halves 9 and 10.

As shown in FIG. 3, the shell-halves 9 and 10 are hollow. An electrically conducting plate 19 is welded to the right side of the part 17 and carries a printed circuit on a conventional insulating board 20. The edges of the plate 19 are rounded to mate with the interior shape of the shell-half 9 with which they are in good electrical contact. The printed circuit itself has an impedance band line characteristic of 50 ohms and includes a narrow electrically conducting strip 21 arranged symmetrically in the extension of the conductor 14; two lateral electrically conducting strips 22 and 23 extending respectively over the upper and lower zones of the insulating board 20 and connected to the plate 19 with which they form the printed circuit ground; the two connecting leads of a capacitor 24 to connect the capacitor to strips 21 and 22; and an electrically conducting strip 28 which is perpendicular to the narrow electrically conducting strip 21 and connects strip 21 to ground through strip 23; the strip 28 behaves electrically as a self-inductance at the frequencies in question.

The two shell-halves 9 and 10 form between them and near their small bases a hole 25 through which passes an insulated axial conductor 26 which extends into the bore 11 of the part 7 after having passed through the space between the parts 6 and 7. The hole 25 and the bore 11 are preferably of the same diameter as the bore in the part 17. It should be pointed out that the thickness and position of the assembly formed by the plate 19 and the insulating board 20 are such that the strip 21 is disposed precisely in the plane of the conductor 14 and of the conductor 26, that is to say, along the axis of the wire 1.

The part 7 may comprise a chamber similar to the chamber 12, but it will preferably have a bore, such as the bore 11, which extends right through it. Fitted at least partially within the axial bore 11 and at the end of the conductor 26 is a cylinder or tube 27 of an insulating material, such as polytetrafluoroethylene, the position of which is adjustable by means of a suitable tool inserted through the bore 11.

By way of example, the diameter of the thick wire 1 is approximately ten times as great as that of the folded wire. Considering such a doublet antenna without the extension of the conductor 26 beyond the hole 25 and without the compensating printed circuit 20, the conductor 14 being extended to the conductor 26, measurements have shown that for a total height of the doublet antenna of 2h and operating frequencies corresponding to $2h/\lambda$, variable between $0.16\lambda$ and $0.175\lambda$, the resistance of the radiation impedance remained between 15 and 100 ohms, the reactance of this impedance being positive and increasing, that is to say, equivalent to the reactance of a self-inductance.

Figure 1:
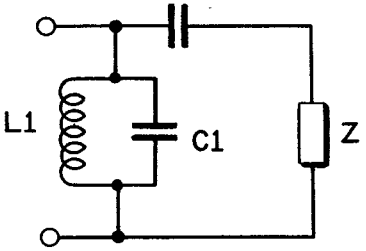
FIG. 1 illustrates the electric circuit for the radiation impedance of the shortened doublet antenna and the compensating components.

As shown in FIG. 1 where the impedance of the doublet antenna alone is indicated by Z, the reactance of Z may be compensated with the aid of a capacitance C, the losses of which are negligible in view of the resistance of Z, and this ensures an excellent yield. Furthermore, the residual susceptance of the assembly consisting of the capacitance C and the impedance Z may be compensated by an antiresonant circuit L1, C1 arranged in parallel as shown in FIG. 1. A compensated doublet antenna of this kind, the thick wire 1 (FIG. 2) of which has a diameter such that $\Omega=5.1$, has an overvoltage coefficient of approximately 18. If this result is compared with those indicated above for a conventional doublet antenna of like diameter, it appears that the thick folded compensated doublet antenna in accordance with the invention offers the advantage of a greater band width as well as the advantage of a greater input resistance combined with an excellent adaptive yield, the more so since it does not require an impedance transformer.

In practice, as shown in FIG. 2, the series capacitance C is constituted by the axial conductor 26 which extends into the bore 11 and thus forms an open coaxial line of small length compared with the wavelength, this line being practically without loss in view of the radiation resistance of the doublet antenna alone. It has, for example, a value of approximately 1pF. It is readily adjustable by sliding the cylinder 27.

The capacitor 24 has a capacitance equal to C1 and is arranged in parallel with the impedance of the doublet antenna since it has a terminal connected to the strip line 21, connecting the conductor 14 to the conductor 26, and a further terminal leading to ground. The strip line 28 has a self-inductance equal to L1 arranged in parallel between the narrow electrically conducting strip 21 and ground. Thus, the capacitor 24 and the electrically conducting strip 28 constitute a specific example of the antiresonant circuit C1, L1. The capacitor 24 is adjustable and is accessible when the shell-half 10 is removed, and this enables the compensation to be adjusted. In practice, the capacitor 24 can be set to values between 10 and 60 pF, for example.

Measurements were carried out on a folded doublet antenna made in accordance with the invention and having a height of 12.5 cm, the diameter of its thick wire 1 being 2.6 cm, and that of the folded wire, 0.24 cm; the antenna incorporated a fine coaxial cable 13 having a dimension of 0.23 cm and extending in succession through the support 5, the left-hand part of the wire 2, the cheek 3 and the chamber 12. The results showed that in an operational frequency band based on 402 MHz, the stationary waves ratio, at 399 to 406 MHz approximately, was less than the acceptable value of 2.5 when compensating with the series capacitor C alone. When the parallel compensation was added, the stationary waves ratio remained acceptable between approximately 400 and 413 MHz, and this is quite remarkable for an antenna of such small dimensions at these frequencies. It was shown that at 200 MHz, the parallel compensation is still more efficient in the case of dimensions relatively close to those stated above.

Also, measurements have shown that the angle $\alpha$ (FIG. 2) at the apices of the frusto-conical portions of the parts 6 and 7 should preferably be between approximately 100° and 120°.

It is obvious that, in order to direct a doublet antenna in accordance with the invention, it has to be mounted in front of a reflector, and measurements have shown that the advantages of the doublet antenna alone were virtually retained. In particular, a doublet antenna in accordance with the invention was placed in front of a reflector at a distance of approximately 0.14λ, and it could be shown that a good adaptive yield could be achieved since the maximum isotropic gain that was measured was 7.5 dB along the axis.

Although the principles of the present invention have been described above in relation to a particular embodiment, it will be understood that said description has been provided merely by way of example and that the scope of the invention is not limited thereby.

What is claimed is:

1. A folded doublet antenna comprising:

first and second substantially cylindrical members, each having a frusto-conical end portion;

a third substantially cylindrical member coupled to the ends of said first and second members distant from said frusto-conical end portions for supporting said first and second members axially spaced from each other with their respective frusto-conical end portions facing each other;

a coaxial conductor having an inner conductor extending through a bore in said first member and into a facing bore in said second member, said inner conductor terminating within and electrically insulated from said second member;

means for supplying signals to said coaxial conductor, the wavelength of said signals having a desired relationship to a dimension of said antenna; and impedance compensation circuit means mounted in one of said first and second members and interposed in said coaxial conductor for compensating the impedance of said doublet antenna alone.

2. A folded doublet antenna according to claim 1, further comprising a cylindrical insulating member mounted in the bore of said second member near the termination therein of said inner conductor for axial movement within said second member.

3. A folded doublet antenna according to claim 1, wherein said impedance compensation circuit means is mounted in said first member and comprises a printed circuit having a first axially extending conducting strip coaxial with and connecting the portions of said inner conductor interrupted by said compensation circuit means, a second axially extending conducting strip radially spaced from said first conducting strip and connecting the portions of the outer conductor of said coaxial conductor interrupted by said compensation circuit means, said outer conductor being electrically grounded to said first member, a capacitor coupled between said first conducting strip and ground, and a third conducting strip coupled between said first strip and ground and having the electrical characteristic of a self-inductance at the operating frequency of said antenna.

4. A folded doublet antenna according to claim 3, wherein said impedance compensation circuit means has a band line characteristic of 50 ohms and the direction of said third strip is normal to said first strip.

5. A folded doublet antenna according to claim 1, wherein the angle at the apices of said frusto-conical portions is between 100° and 120°.

6. A folded doublet antenna comprising:

first and second substantially cylindrical members, each having a frusto-conical end portion, and substantially equal diameters;

a third substantially cylindrical member coupled to the ends of said first and second members distant from said frusto-conical end portions for supporting said first and second members axially spaced from each other with their respective frusto-conical end portions facing each other, the diameter of said third member being approximately one-tenth the diameter of said first and second members;

a coaxial conductor having an inner conductor extending through a bore in said first member and into a facing bore in said second member, said inner conductor terminating within and electrically insulated from said second member, said coaxial conductor having an impedance of approximately 50 ohms; and means for supplying signals to said coaxial conductor, the wavelength of said signals being approximately six times the total height of said antenna.

7. A folded doublet antenna comprising:

first and second substantially cylindrical members, each having a frusto-conical end portion;

a third substantially cylindrical member coupled to the ends of said first and second members distant from said frusto-conical end portions for supporting said first and second members axially spaced from each other with their respective frusto-conical end portions facing each other;

a coaxial conductor having an inner conductor extending through a bore in said first member and into a facing bore in said second member, said inner conductor terminating within and electrically insulated from said second member;

means for supplying signals to said coaxial conductor, the wavelength of said signals having a desired relationship to a dimension of said antenna; and wherein said antenna is disposed in front of a reflecting plane at a distance approximately equal to one-seventh of the operating wavelength.

* * * * *